United States Patent [19]

Bald et al.

[11] Patent Number: 4,631,948

[45] Date of Patent: Dec. 30, 1986

[54] ROLL STAND WITH BRACED AND OFFSET WORKING ROLLS

[75] Inventors: Wilfried Bald, Hilchenbach; Erich Stoy, Ratingen; Hans Römmen, Dormagen; Friedrich Hollmann, Grevenbroich, all of Fed. Rep. of Germany

[73] Assignee: SMS Schloemann-Siemag AG, Dusseldorf, Fed. Rep. of Germany

[21] Appl. No.: 595,947

[22] Filed: Apr. 2, 1984

[30] Foreign Application Priority Data

Apr. 2, 1983 [DE] Fed. Rep. of Germany ..... 3312008
Jun. 30, 1983 [DE] Fed. Rep. of Germany ..... 3323641

[51] Int. Cl.[4] ..... B21B 27/10; B21B 31/18; B21B 31/32

[52] U.S. Cl. ..... 72/242; 72/202; 72/236; 72/243; 72/245; 72/247

[58] Field of Search ..... 72/241, 242, 243, 245, 72/21, 236, 247, 202

[56] References Cited

U.S. PATENT DOCUMENTS 2,601,792 7/1952 Dahlstrom ..... 72/21
3,596,489 8/1971 Ball ..... 72/242

FOREIGN PATENT DOCUMENTS 2522213 8/1979 Fed. Rep. of Germany .
1777054 5/1980 Fed. Rep. of Germany .
3212070 10/1982 Fed. Rep. of Germany .
17310 1/1982 Japan ..... 72/243
106411 7/1982 Japan ..... 72/241
0947014 1/1964 United Kingdom ..... 72/243
0579048 11/1977 U.S.S.R. ..... 72/243

*Primary Examiner*—Francis S. Husar
*Assistant Examiner*—Steve Katz
*Attorney, Agent, or Firm*—Karl F. Ross; Herbert Dubno

[57] ABSTRACT

A rolling stand has a support frame, a pair of small-diameter working rolls defining a workpiece nip open perpendicular to the plane and rotatable about respective horizontal, parallel, and vertically spaced axes. A pair of large-diameter backup rolls are rotatable about respective axes parallel to and vertically flanking the working-roll axes. These backup-roll axes define a vertical plane offset from the working-roll plane. In addition each backup roll bears vertically on the respective working roll and a drive counterrotates the rolls of each roll pair to draw an elongated workpiece of predetermined maximum width generally perpendicular to the planes through the nip. The working rolls are longer than the maximum workpiece width and have end portions projecting axially beyond the workpiece. The rolls are pressed vertically toward the nip to compress and deform the workpiece thereat. Respective pushing elements engage horizontally generally perpendicular to the planes against the end portions of the working rolls and respective actuators push these elements horizontally generally perpendicular to the planes against the end portions of the working rolls.

7 Claims, 7 Drawing Figures

ROLL STAND WITH BRACED AND OFFSET WORKING ROLLS

FIELD OF THE INVENTION

The present invention relates to a roll stand for cold rolling. More particularly this invention concerns such a stand used in the finishing of steel strip.

BACKGROUND OF THE INVENTION

A standard cold-rolling stand has a support frame, a pair of small-diameter working rolls rotatable about respective horizontal, parallel, and vertically spaced axes defining a workpiece nip, and a pair of large-diameter backup rolls rotatable about respective axes parallel to and vertically flanking the working-roll axes and defining a vertical plane offset from the plane of the working-roll axes. Each backup roll bears vertically on the respective working roll and the rolls of each pair are counterrotated to draw an elongated workpiece of predetermined maximum width generally perpendicular to the planes through the nip. The rolls are pressed vertically toward the nip to compress and deform the workpiece in the nip.

In order to maximize pressure on the workpiece, the diameter of the working rolls is as small as possible, thereby reducing the contact area and increasing the pressure. Since the working-roll plane is offset in the workpiece travel direction from the backup-roll plane, the compressive forces effective parallel to the planes have a component perpendicular thereto which can bow the slender working rolls.

Thus bracing systems are provided in counteract this bowing. The standard practice is to flank each working roll with a pair of small bracing rolls that stiffen the working roll, preventing the stand from vibrating. Such an arrangement is fairly effective but substantially increases the wear of the working rolls while flaws in the strip being rolled can damage the equipment.

Another disadvantage of the known roll stands, as described in German patent documents Nos. 1,777,054, 2,522,213, and 3,212,070 respectively filed June 28, 1966, May 17, 1975, and Apr.01, 1982 by K. Liefeld, H. Rommen et al, and T. Iwanami et al, is that the working rolls are effectively covered up by the bracing equipment, so spraying a coolant and lubricant on them is nearly impossible.

It has been suggested to eliminate this bracing, and to replace it with a lateral offset of the working rolls to compensate for the horizontal forces. Such an arrangement cannot respond rapidly to changing working conditions. Thus for example on closing of the nip at first there is only the rolling force to deal with, the torque and the angular force only becoming effective on startup, that is when the workpiece is fed in. When the strip breaks or has serious flaws, it is impossible to take any effective measures so that the rolls can be damaged.

SUMMARY OF THE INVENTION

A rolling stand according to the invention has a support frame and a pair of small-diameter working rolls rotatable about respective horizontal, parallel, and vertically spaced axes defining a workpiece nip open perpendicular to the plane. A pair of large-diameter backup rolls are rotatable about respective axes parallel to and vertically flanking the working-roll axes. These backup-roll axes define a vertical plane offset from the working-roll plane. In addition each backup roll bears vertically on the respective working roll and a drive counterrotates the rolls of each roll pair to draw an elongated workpiece of predetermined maximum width generally perpendicular to the planes through the nip. The working rolls are longer than the maximum workpiece width and have end portions projecting axially beyond the workpiece The rolls are pressed vertically toward the nip to compress and deform the workpiece thereat. Respective pushing elements engage horizontally generally perpendicular to the planes against the end portions of the working rolls and respective actuators push these elements horizontally generally perpendicular to the planes against the end portions of the working rolls.

Such an arrangement can avoid damage to the equipment even if the strip breaks or is loaded in or runs incorrectly. The equipment nonetheless is fairly simple and can be counted on to have a long service life.

According to another feature of this invention the pushing elements are mounted on a guide for axial movement as well as movement generally perpendicular to the planes. The pushing elements for each working roll are rollers and the guide system can adjust the axial spacing between the rollers.

Normally according to this invention the pushing elements are movable axially through a relatively long distance but only through a relatively short distance generally perpendicular to the planes. The guide means includes a beam extending axially adjacent the working rolls, or respective beams extending axially adjacent the working rolls. In addition the guide means includes a drive for displacing the pusher elements of each working roll axially, oppositely, and synchronously. Such a drive has respective spindles each having screwthreads threadedly engaging the respective pushing elements.

The working rolls of this invention are substantially unsupported between the respective end portions. Thus the working rolls can be sprayed with a lubricant/coolant liquid with ease.

The system of this invention can also be used in arrangements having noncylindrical rolls as are used in tandem rolling strings. The rolls can be bent positively or negatively, and the arrangement can be used in a six-high stand also.

DESCRIPTION OF THE DRAWING

The above and other features and advantages will become more readily apparent from the following, reference being made to the accompanying drawing in which.

SPECIFIC DESCRIPTION

Figure 1:
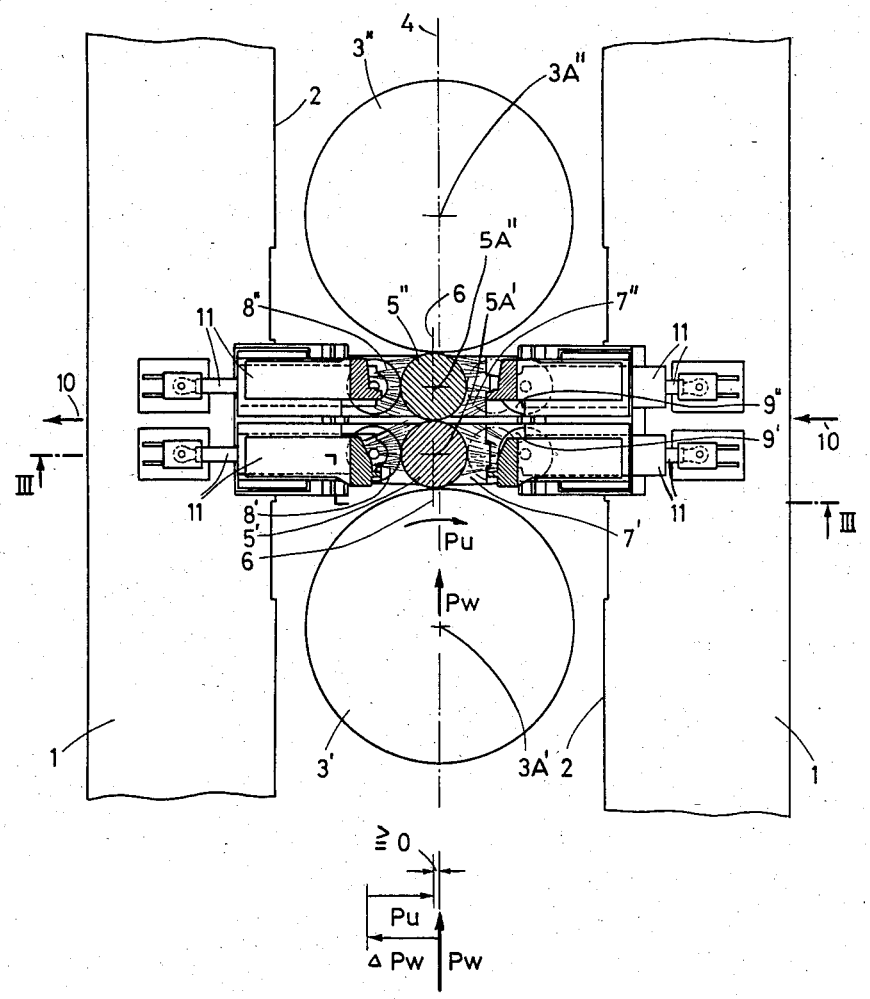
FIG. 1 is a vertical section through a four-high stand according to this invention.

As seen in FIG. 1 a roll stand according to this invention has a housing 1 formed with a horizontally open window 2 in which a pair of large-diameter backup rolls 3' and 3'' are rotatable about respective axes 3A' and 3A". Journal blocks support the rolls 3' and 3" and allow them to move vertically in the frame or housing 1. Two small-diameter working rolls 5' and 5" are similarly supported in journal blocks 7' and 7" in the frame 1 for rotation about axes 5A' and 5A". Such an arrangement is described in commonly owned patent applications Ser. No. 558,165 filed Dec. 05, 1983 and Ser. No. 587,231, to which reference should be made for further structural details. The axes 3A' and 3A" define a vertical plane 4 and the axes 5A' and 5A" a plane 6 parallel thereto but offset horizontally by a small distance determined by the relationship between the force Pw parallel to these planes 4 and 6 and the angular force Pu about the axes 3A' and 3A".

Figure 2:
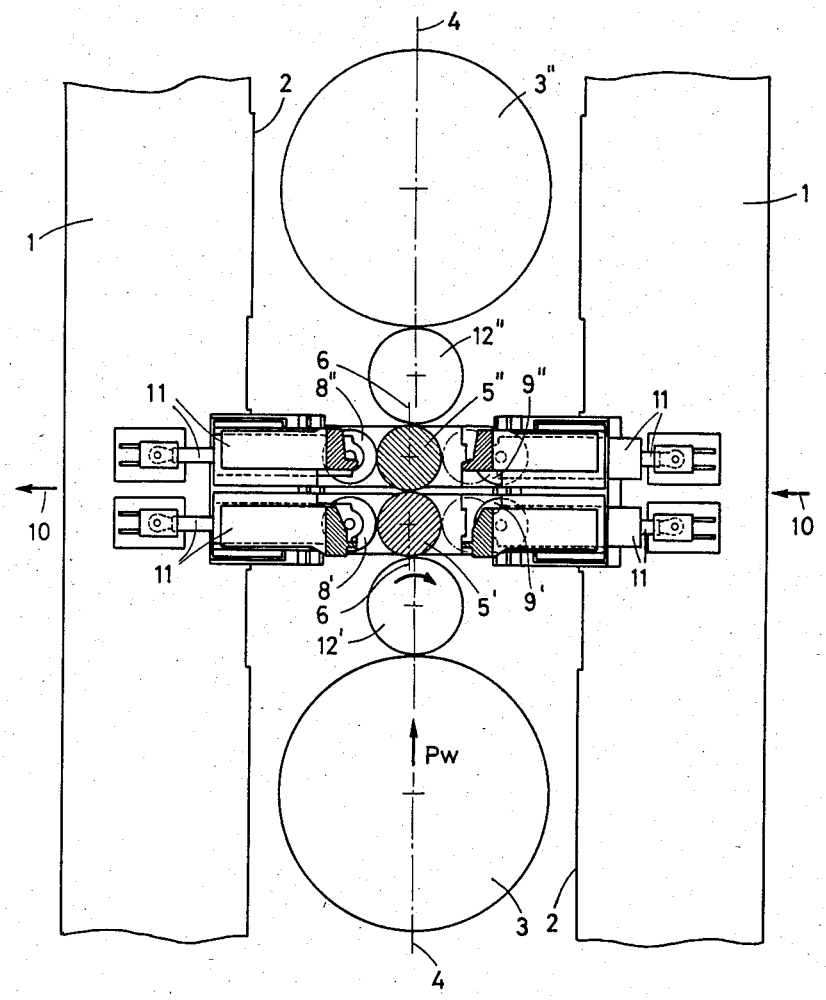
FIG. 2 is a section like FIG. 1 through a six-high stand in accordance with this invention.

The system can also be a six-high stand such as described in copending patent applications Ser. No. 352,250 and U.S. Pat. No. 4,510,783 both filed by H. Rommen et al as shown in FIG. 2. Here intermediate-diameter inner backup rolls 12' and 12" centered on axes lying on the upstream plane 4 are provided between the outer backup rolls 3' and 3" and the working rolls 5' and 5". In all other respects the systems of FIGS. 1 and 2 are identical.

Figure 3:
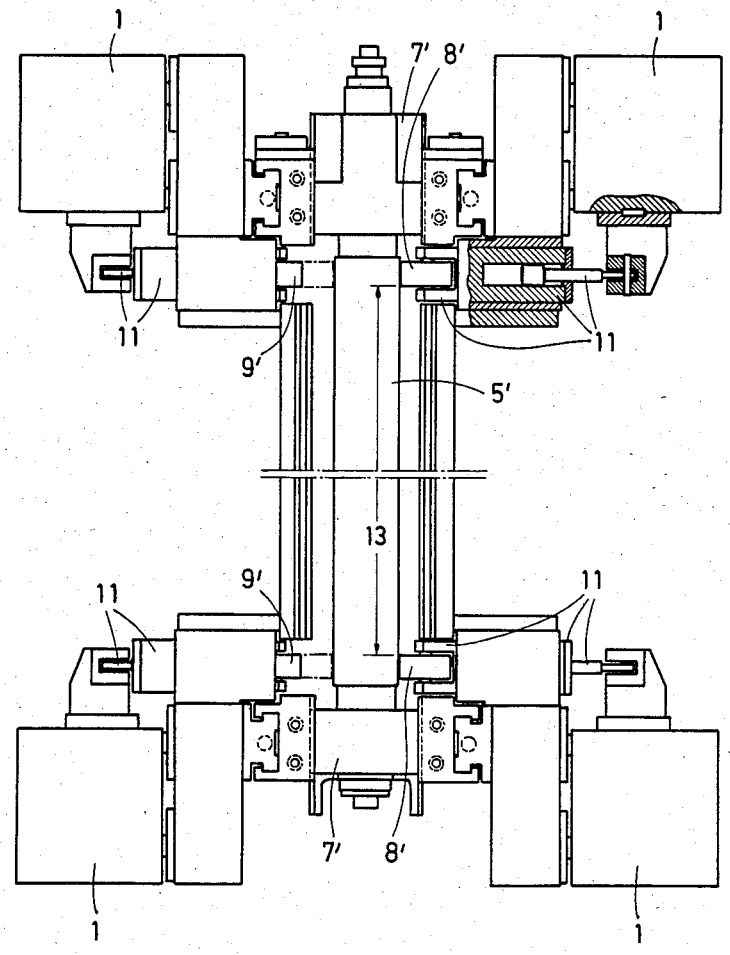
FIG. 3 is a section taken along line III—III of FIG. 1 or 2.
Figure 4:
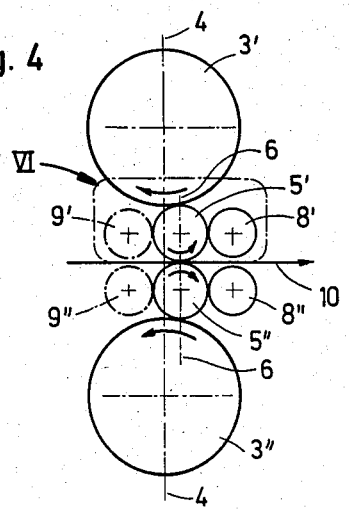
FIG. 4 is a largely schematic end view of another roll stand according to the present invention.
Figure 5:
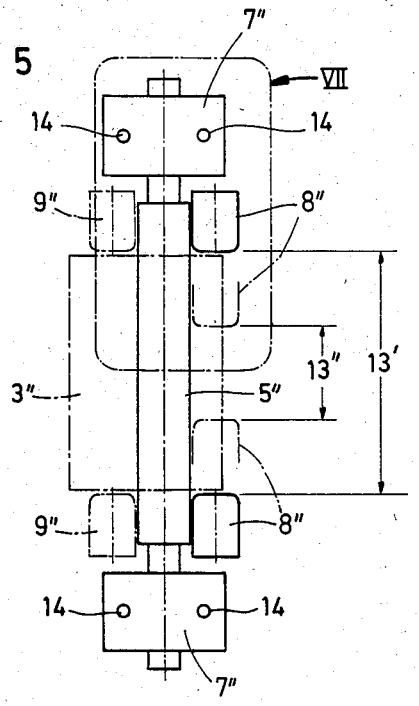
FIG. 5 is a top view of the stand of FIG. 4.
Figure 6:
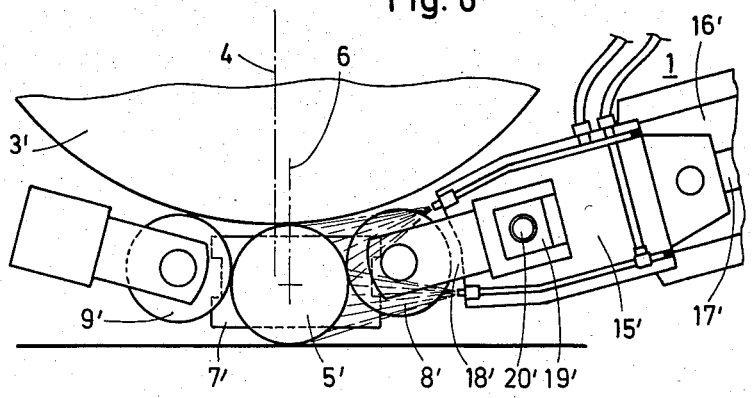
FIGS. 6 and 7 are large-scale and partly sectional views of the details indicated at VI and VII in respective FIGS. 4 and 5.
Figure 7:
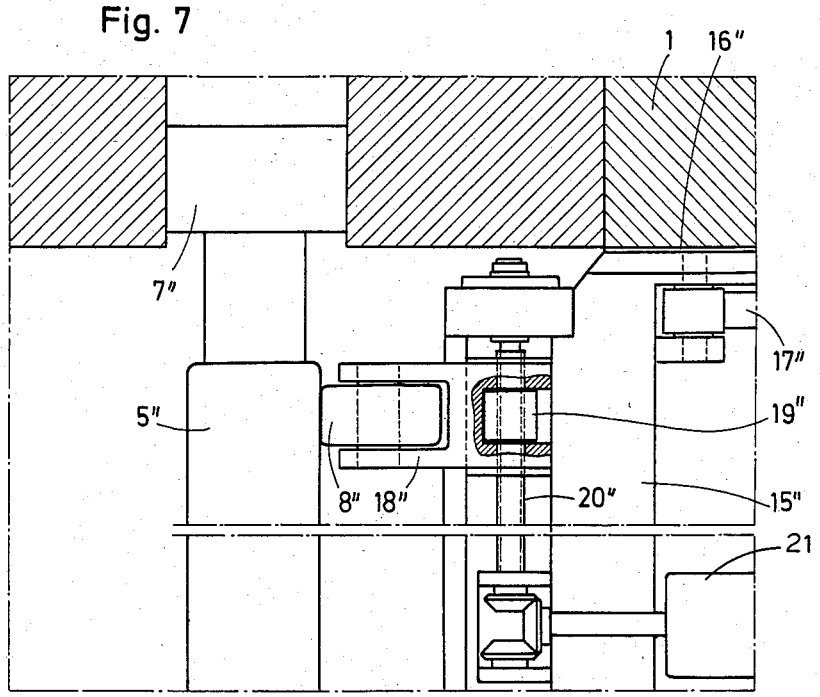

According to this invention a workpiece passes through the nip defined by the two rollers 5' and 5", shown touching for convenience of illustration, in a direction 10. The working rolls 5' and 5" are as shown in FIG. 3 of a length substantially greater than the maximum workpiece width 13 and have outer end portions braced against downstream rollers 8' and 8" and upstream rollers 9' and 9", the center portions of the rolls 5' and 5" being clear so that liquid coolant/lubricant sprays can be directed against them. Thus the rollers 8', 8", 9', and 9" do not take an active part in the rolling process, only engaging portions of the working rolls 5' and 5" that are not in contact with the workpiece.

Actuators in the form of respective double-acting hydraulic cylinders 11 are braced between the pusher rollers 8', 8", 9, and 9" and the frame 1 for displacing them in and against the direction 10. Which way the principal force is directed is dependent on the diameter of the working rolls 5' and 5" and on whether the stand is used in one or both directions. The rollers 8', 8" or 9', 9" that are effective outside the contact region of the rolls 5' and 5" with the workpiece position the rolls 5' and 5" definitely relative to the backup rolls 3' and 3". Even when flaws appear in the workpiece or during startup or running, it is possible to compensate and correct with the system of this invention. In these situations damage to the working rolls is largely eliminated.

The rolls 8', 8", 9', and 9" not only protect the working rolls and reduce interruptions in production, but also serve to bow the rolls 5' and 5" horizontally between their journal blocks 7' and 7". The actuators 11 are independently controlled to produce the desired bowing.

In the arrangement of FIGS. 4 through 7 the same reference numerals as in FIGS. 1 through 3 are used for structurally and functionally identical things. Here actuators 14 are provided for vertically displacing and bending the working rolls 5' and 5". In addition the maximum workpiece width 13' is shown as well as the minimum width 13".

According to this arrangement the two rollers 8' and 8", which are mounted and function identically to the rolls 8' and 9", are carried in yoke holders 18' and 18" slidable on transverse beams 15' and 15" extending parallel to the axes 3A', 3A", 5A', and 5A" of the stand. These beams 15' and 15" in turn are carried in guides 16' and 16" in the frame 1 and are displaceable therein by actuators whose piston rods 17' and 17" are shown in the drawing.

A two-part spindle 20', 20" has its threaded ends received in nuts 19' 19" of the roller holders 18' and 18". A drive 21 has a bevel gear meshing with bevel gears at the ends of these spindles 20' and 20" so that when rotated in one direction the two holders 18' or 18" move toward each other, symmetrical to a perpendicular symmetry plane of the system, and when rotated in the opposite direction they move apart.

Normally the rollers 8', 8", 9', and 9" are adjusted to the narrowest width possible, a spacing slightly larger than the actual workpiece width. Thus with wide workpieces it is necessary that the working rolls 5' and 5" be somewhat longer than the maximum workpiece width expected to be encountered, although the backup rolls need be no longer than this maximum workpiece width. With the system of this invention the ratio between the diameter and length of the cylindrical workpiece-engaging part of the roll is between 1:5 and 1:15. Sufficient resistance to bending is achieved by offsetting the working-roll plane 6 from the backup-roll plane 4, with the former downstream of the latter relative to the direction 10.

The rollers 8', 8", 9', and 9" could be replaced by hydrostatic saddles, that is each formed with a part-cylindrical seat complementary to the respective working-roll end portion and having a pump for supplying a liquid lubricant to the interface between the seat and working roll. In addition the cylinders 17' and 17" for the guide beams 15' and 15" can be provided with parallel-working sum-and-difference pressure regulation. It is particularly advantageous when the setting of the minimal lateral component to be done automatically by a computer so that the system can continuously be adjusted with the aim of producing a perfect product.

We claim:

1. A rolling stand comprising:

a support frame;

two pairs of vertically spaced journal blocks in the frame defining a pair of horizontal, parallel, and vertically spaced working-roll axes defining a vertical plane;

a pair of elongated small-diameter working rolls having roll necks rotatably mounted in the respective pairs of journal blocks about the respective axes, the working rolls having working surfaces defining, along at least an axial portion, a workpiece nip open perpendicular to the plane;

a pair of large-diameter backup rolls rotatably mounted in the frame about respective axes parallel to and vertically flanking the working-roll axes and defining a vertical plane offset from the working-roll plane, each backup roll bearing vertically on the respective working roll;

drive means operatively connected to the rolls for counterrotating the rolls of each roll pair to draw an elongated workpiece of predetermined maximum width in a horizontal direction generally perpendicular to the planes through the nip and thereby exerting on the working rolls a horizontal force perpendicular to the planes and parallel to said horizontal direction, the working rolls having axially spaced end portions adjacent the respective journal blocks;

respective pushing elements engaged horizontally generally perpendicular to the planes against the end portions of the working surfaces beyond said workpiece nip of the working rolls, the working rolls being horizontally unsupported along said axial portion defining said workpiece nip; and means including respective actuators engaging the pushing elements for pushing the elements horizontally generally perpendicular to the vertical roller planes against the end portions of the working rolls for holding and maintaining the two planes horizontally offset from each other.

2. The rolling stand defined in claim 1, further comprising guide means carrying the pushing elements for axial movement of the pushing elements as well as movement generally perpendicular to the planes.

3. The rolling stand defined in claim 1 wherein the pushing elements are mounted for axial movement-inserted therefor; and relative to the working rolls through a predetermined distance but only through another distance shorter than the predetermined distance generally perpendicular to the planes.

4. The rolling stand defined in claim 1, further comprising a beam extending axially adjacent the working rolls, fixed on the frame, and carrying the pushing elements.

5. The rolling stand defined in claim 1, further comprising respective beams extending axially adjacent the working rolls and carrying the pushing elements.

6. The rolling stand defined in claim 1 further comprising another drive means connected to the pushing elements for displacing the pushing elements of each working roll axially, oppositely, and synchronously.

7. The rolling stand defined in claim 6 wherein the other drive means includes respective spindles each having opposite screwthreads threadedly engaging the respective pushing elements.

* * * * *